United States Patent [19]

Portilla

[11] 4,421,045

[45] Dec. 20, 1983

[54] AUTOMATED THREAD TRIMMING APPARATUS FOR USE FOR SEWING MACHINES

[76] Inventor: Mario Portilla, 1975 Troy Ave., Brooklyn, N.Y. 11234

[21] Appl. No.: 374,998

[22] Filed: May 5, 1982

[51] Int. Cl.[3] ..... D05B 65/04

[52] U.S. Cl. ..... 112/288; 112/130; 112/163; 112/294; 112/300; 112/301

[58] Field of Search ..... 112/130, 129, 163, 167, 112/164, 165, 166, 288, 294, 301, 300

[56] References Cited

U.S. PATENT DOCUMENTS

| | | | |
|---|---|---|---|
| 2,705,466 | 4/1955 | Sargrove et al. | 112/130 X |
| 3,472,189 | 10/1969 | White | 112/288 |
| 3,550,545 | 12/1970 | Cremer | 112/130 |
| 3,848,555 | 11/1974 | Boser | 112/288 |

*Primary Examiner*—H. Hampton Hunter

*Attorney, Agent, or Firm*—Hedman, Casella, Gibson, Costigan and Hoare

[57] ABSTRACT

An automated thread trimming apparatus is provided for use with a sewing machine having a plurality of needles. The apparatus is mounted on the side of the sewing machine away from the sewing machine operator. A pair of blades is provided for each needle of the sewing machine. The blades are adjustably mounted on blade mounting bars. Upon actuation, the blades are positioned to straddle each array of stitches produced by the sewing machine needles. The blade mounting bars are then moved slidably relative to one another so that each pair of blades severs an array of stitches. The blade mounting bars are then moved away from the work table of the sewing machine allowing the next workpiece to be sewn.

13 Claims, 5 Drawing Figures

AUTOMATED THREAD TRIMMING APPARATUS FOR USE FOR SEWING MACHINES

BACKGROUND OF THE INVENTION

Sewing machines are used for a variety of industrial and manufacturing purposes. In most of these applications the sewing machine is specifically adapted or adjusted to perform a specific repetitive sewing operation. This specific sewing operation will be performed on successive workpieces as rapidly as possible. The efficiency of the machines and the operators, of course, varies directly with the frequency at which properly fabricated workpieces may be produced.

For example, industrial sewing machines fabricate seat covers for automobiles. The seat covers generally are manufactured from layers of fabric material. The top layer may be vinyl, nylon and velour. Other layers are provided for strength and cushioning. In most instances, the layered material is approximately one half inch thick. To improve the appearance of the seat cover, and to reduce friction between layers, a tucked or rolled design often is provided by sewing parallel seams into the seat cover material. Each seam draws the opposite surfaces of the layered material close together, however, the sections of the layered material between seams retain their normal thickness.

The seat cover described above, and many similar products, are manufactured on specially adapted industrial sewing machines. For example, the seat cover could be sewn quite efficiently on a standard chain-stitching sewing machine that is adapted to include a separate needle for each seam to be sewn on the seat cover. Thus, on a seat cover requiring four seams, the sewing machine would be adapted to include four needles. By this arrangement, as the workpiece is passed through the sewing machine, four parallel seams will be sewn simultaneously.

As mentioned above, the machine that is adapted to perform this sewing operation would be the chain stitching type. These machines utilize at least two threads for each needle to establish an interlocking arrangement of threads to firmly hold the upper and lower surfaces of the workpiece in close proximity to one another. This strong interlocking engagement is extremely important in many applications, such as seat covers, since it often is difficult to correct an improperly sewn section after the workpiece has been placed in its final position. Thus, care must be taken during the initial sewing operation to insure that the workpiece is properly stitched, and that no unraveling is likely to occur.

Many stitching arrangements, including chain stitches, are subject to unraveling at the points where the stitching starts and stops. Specifically, at the beginning or end of a chain produced by a chain stitching machine, the threads from which the chain is formed are subject to unraveling. Consequently, precautions must be taken to insure that any unraveling that does occur does not affect the workpiece.

The most common precaution to pretect against unraveling of the chain into the workpiece is to continue production of the stitched chain several inches past the end of the workpiece. Typically, the chain would be extended some five or six inches past the end of the workpiece, and then the machine would be stopped. At this point the extended chains would be severed approximately midway between the needles of the sewing machine and the trailing edge of the workpiece that had just been completed. By this arrangement, two or three inch chains would extend from the trailing edge of the workpiece, and any unraveling that might occur would affect the chain and not the workpiece. It logically follows that the portions of the chains between the severences and the sewing machine needles would provide the necessary protection against unraveling of the chains on the leading edge of the next workpiece. In a subsequent manufacturing step a stitch would be sewn around the perimeter of the workpiece to permanently prohibit unraveling of the chain into the workpiece.

In most sewing operations the severance of the chain stitch between successive workpieces is accomplished manually by the operator of the sewing machine with either standard scissors or an equivalent form of hand held electrical shears. Thus, the worker, who normally sits on the side of the machine into which the workpiece is fed, must stop the machine, pick up the scissors, cut the chains on the opposite side of the sewing machine, place the scissors in a location where they will not interfere with subsequent work, and sew the next workpiece.

The worker generally can complete this chain cutting operation from a sitting position if the sewing machine has only one needle. However, as mentioned above, many sewing machines used for industrial purposes are adapted to accommodate several needles. If, for example, the sewing machine is adapted with four needles, it will be virtually impossible for the worker to remain seated and comfortably reach behind the array of needles to cut all four chains. Thus, the worker using a multi-needle sewing machine must do a substantial amount of reaching and stretching to cut the chains depending from the workpiece. In most instances, in fact, the worker must stand up to have proper access to the chains. It follows logically that the chain cutting task becomes increasingly more arduous as the number of needles on the sewing machine increases. As a result, attempts to increase efficiency by sewing many chains at once results in decreased efficiency on the part of the worker who must cut the chains.

The manual cutting of thread chains is undesirable for at least four reasons. First, a substantial amount of time is required for the worker to stop the machine, pick up the scissors, reach behind the machine, cut the chains, return the scissors to a proper location and start sewing again. The time devoted to this thread cutting task has a substantial effect on the efficiency of the entire sewing operation. Second, the reaching, stretching and frequent standing required to perform the chain cutting operation takes a significant toll on the sewing machine operators. Specifically, employers report a high degree of arm, shoulder and back injuries among sewing machine operators partially as a result of the excess movement required to cut the thread chains. The frequency of these injuries can be better appreciated in view of the fact that a worker typically completes several hundred workpieces in a single day. Third, to manually attain access to the thread chains, the worker must reach into an area which has many moving parts and which is partially out of view. This of course creates a risk of injuries to hands and fingers. Finally, the arrangement of most sewing machines requires the worker to cut the chain left handed, thus making this awkward task even more cumbersome.

Many attempts have been made to facilitate the chain cutting task. For example, some employers have assigned one employee to cut the chains for several sewing machines. This approach, however, adds significantly to operating costs. It also is difficult to schedule the rate of sewing to insure that no machine sits idle while waiting for the thread cutter.

Other attempts have been made to locate sewing machines such that each sewing machine operator can cut threads on an adjacent machine. However, as above, it is difficult to schedule the sewing rate for adjacent machines. Thus, one machine may sit idle waiting for the worker on an adjacent machine to reach a stopping point. Alternatively, one worker could have to stop in the middle of a workpiece to cut threads on an adjacent machine. Either approach results in decreased operating efficiency.

Several attempts have been made to mechanize the cutting of thread chains. For example, a large blade extending perpendicular to the chains has been mounted on the side of the sewing machine toward which the workpiece moves. The blade can be activated to move downward, and thereby cut the chains. This large blade, however, was found to be extremely hazardous in proximity to the parts of the machine where workers might reasonably place their hands. Consequently, this type of cutter generally is placed several feet from the machine to insure the safety of the sewing machine operators. This approach, however, requires an extended table for sewing operations, plus at least one additional set of mechanical pullers to move the workpiece from the sewing machine to the cutter. This arrangement also requires substantially more space than is typically allocated to sewing machines. As a result, there are substantial excess operating costs due to the inefficient use of space. Additionally, the reliance on several mechanical pullers increases the probability of a failure of mechanical parts.

There have been other similar attempts to utilize electrically generated heat to burn through the thread chain. These devices, however, were considered to be fire hazards, particularly in the dusty environment in which the sewing machines often are used.

Accordingly, it is an object of the subject invention to provide an apparatus for trimming the thread chains that are generated in performing a sewing operation.

It is a further object of the subject invention to provide an apparatus that can be safely used to trim the thread chains generated by a sewing machine.

It is an additional object of the subject invention to provide an apparatus that can perform a thread trimming operation quickly, and without interfering with the normal operation of the sewing machine.

It is still another objective of the subject invention to provide a thread cutting apparatus that can be operated in conjunction with existing sewing machines.

It is still a further object of the subject invention to provide a thread trimming apparatus that will not increase the floor space allocated to sewing machines.

It is yet another object of the subject invention to provide a thread cutting apparatus that readily can be adapted to sewing machines having a plurality of needles spaced at varying distances from one another.

SUMMARY OF THE INVENTION

The subject invention is directed to an automated thread trimming apparatus that is attachable to the rear side of the sewing machine. More specifically, the subject apparatus extends at least the length the array of needles used with the sewing machine, and is spaced from the work table of the sewing machine so that the sewn workpiece can readily pass between the work table and the thread trimming apparatus.

The apparatus includes an elongated horizontally disposed frame member which is adapted to enable easy mounting of the apparatus on the rear side of the sewing machine, above and rearward of the array of sewing machine needles. The apparatus also includes two elongated blade mounting bars that are disposed parallel to and in slidable relationship to one another. More specifically, the blade mounting bars are adapted to slide relative to one another along their respective longitudinal axes.

Each blade mounting bar is adapted to accept a plurality of blades. An equal number of blades are mounted on each blade mounting bar, such that pairs of blades are provided on the subject thread cutting apparatus, with each pair including one blade on each bar. The blades of each pair are disposed such that their respective cutting edges face one another and are spaced apart. By this arrangement, the slidable movement of the two blade mounting bars parallel to their respective longitudinal axes will move the cutting edges of each pair of blades toward or away from each other.

The subject thread trimming apparatus is mounted on the rear side of the sewing machine such that the blade mounting bars are parallel to the plane of the sewing machine work table. Each blade mounting bar includes one blade for each needle on the sewing machine, hence the number of pairs of blades corresponds to the number of needles. The blades are located on the respective blade mounting bars with each pair of blades aligned with its respective needle on the sewing machine. Preferably, the blades can be easily relocated on the blade mounting bar to enable the subject apparatus to be readily adapted to other sewing machines.

The subject apparatus includes a means for moving the blade mounting bars toward and away from the sewing machine work table through a plane that is perpendicular to the plane of the sewing machine work table and parallel to the plane of the needles. The apparatus also includes a means to move at least one of the blade mounting bars parallel to its longitudinal axis.

In operation, the blades and blade mounting bars are initially spaced from the sewing machine work table so that the work piece sewn by the sewing machine may be advanced between the work table and the subject thread trimming apparatus. As mentioned above, each pair of blades is substantially aligned with a needle on the sewing machine. Thus, the pairs of blades also are aligned with the seams sewn in the workpiece. As the workpiece is advanced through the sewing machine, thread chains are developed.

After a chain of appropriate length has been attained, the subject apparatus is activated. Specifically, the blade mounting bars are initially moved towards the work table to a position where the blades are at or slightly above the plane of the work table. In this position, each pair of blades will straddle one thread chain. Next, at least one of the blade mounting bars will be moved parallel to its longitudinal axis, so that the cutting edge of at least one blade in each pair of blades is moved toward the cutting edge of the other blade in that pair. This relative movement of the cutting edges of the blades in each pair toward one another will continue at least until the cutting edges meet or slidably overlap in scissor-like fashion. This movement of the blades will sever the thread chains that had been straddled by each pair of blades. After complete movement of the blades toward one another, the blade mounting bars will be returned to their initial position thereby separating the blades in each pair. Finally, the blade mounting bars will be moved away from the work table to their original position, thus enabling the next workpiece to pass between the work table and the subject apparatus as it is sewn.

A means for generating the movement of the blade mounting bars is provided. Preferably, this means is pneumatic, however, hydraulic, electrical or mechanical arrangements are equally acceptable. The means for activating the subject apparatus could be either electrical or mechanical, and the activation could be generated either automatically or by an action of the sewing machine operator. As explained further below, a preferred embodiment includes at least one photoelectric cell mounted in the work table of the sewing machine to automatically sense the appropriate length of the thread chain, and then to activate the subject thread cutting apparatus.

DETAILED DESCRIPTION OF THE PREFERRED EMBODIMENT

Figure 1:
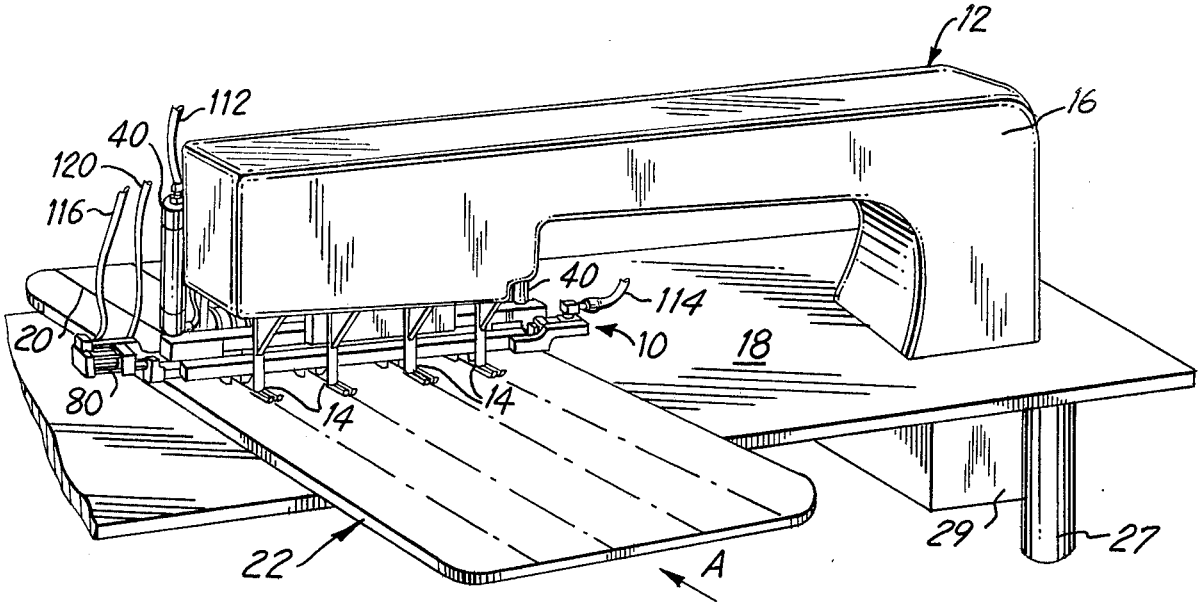
FIG. 1 is a perspective view of a sewing machine having the subject thread trimming apparatus mounted thereon and including a partially completed workpiece.

The subject thread trimming apparatus, designated generally by the numeral 10 in FIG. 1, is mounted on and adapted for use with sewing machine 12. Sewing machine 12 is an industrial model sewing machine which has been adapted to include four needles 14. This adaptation of sewing machine 12 is accomplished by extending both the head 16 of sewing machine 12 and the various operating components located under work table 18 on which sewing machine 12 is mounted. By this arrangement, sewing machine 12 is able to sew four seams 20 simultaneously in workpiece 22. Sewing machine 12 may be adapted for either more or fewer needles 14 than the four that are depicted in FIG. 1.

Figure 2:
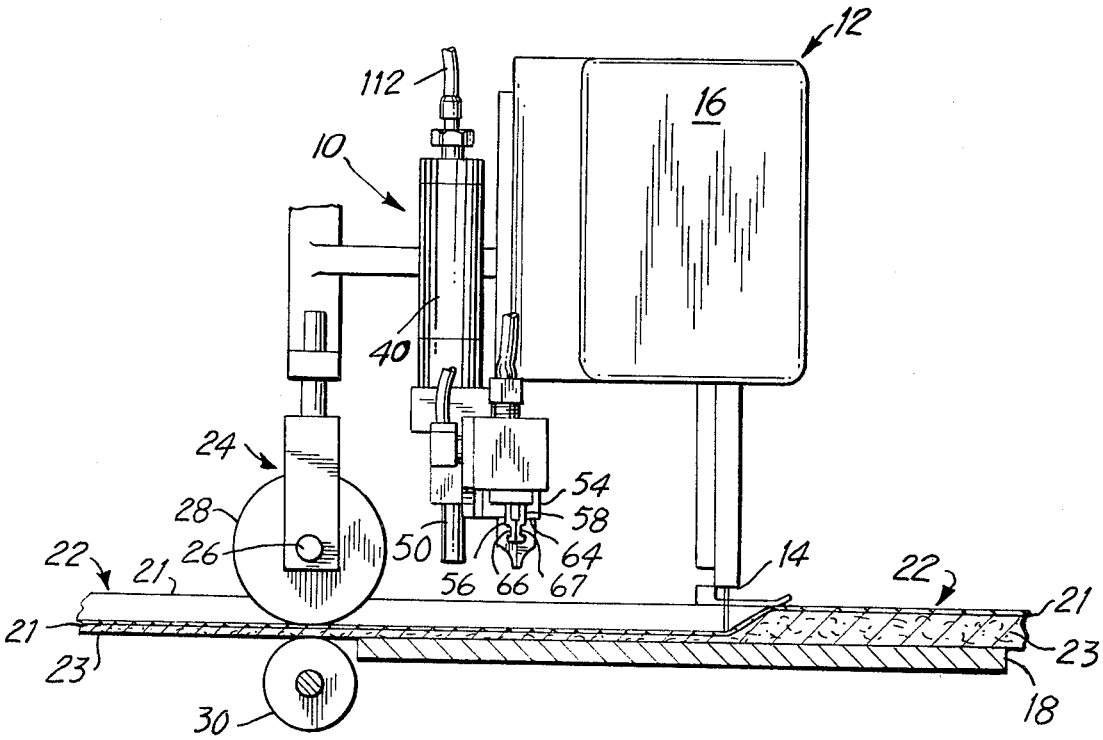
FIG. 2 is an end view, partially in section of a sewing machine and threading trimming apparatus, plus a workpiece puller and feeder for urging the workpiece through the sewing machine.

Sewing machine 12 and thread trimming apparatus 10 can be used with any of a variety of workpieces. Workpiece 22, however, as shown in FIGS. 1 and 2, is a portion of an automobile seat cover. The material from which workpiece 22 is constructed includes a top layer 21, such as vinyl, velour or nylon, and one or more lower layers 23 for padding and strength. Seams 20 are sewn in workpiece 22 for aesthetic enhancement, and also to minimize relative movement between adjacent layers which would be likely to contribute to wear.

Figure 3:
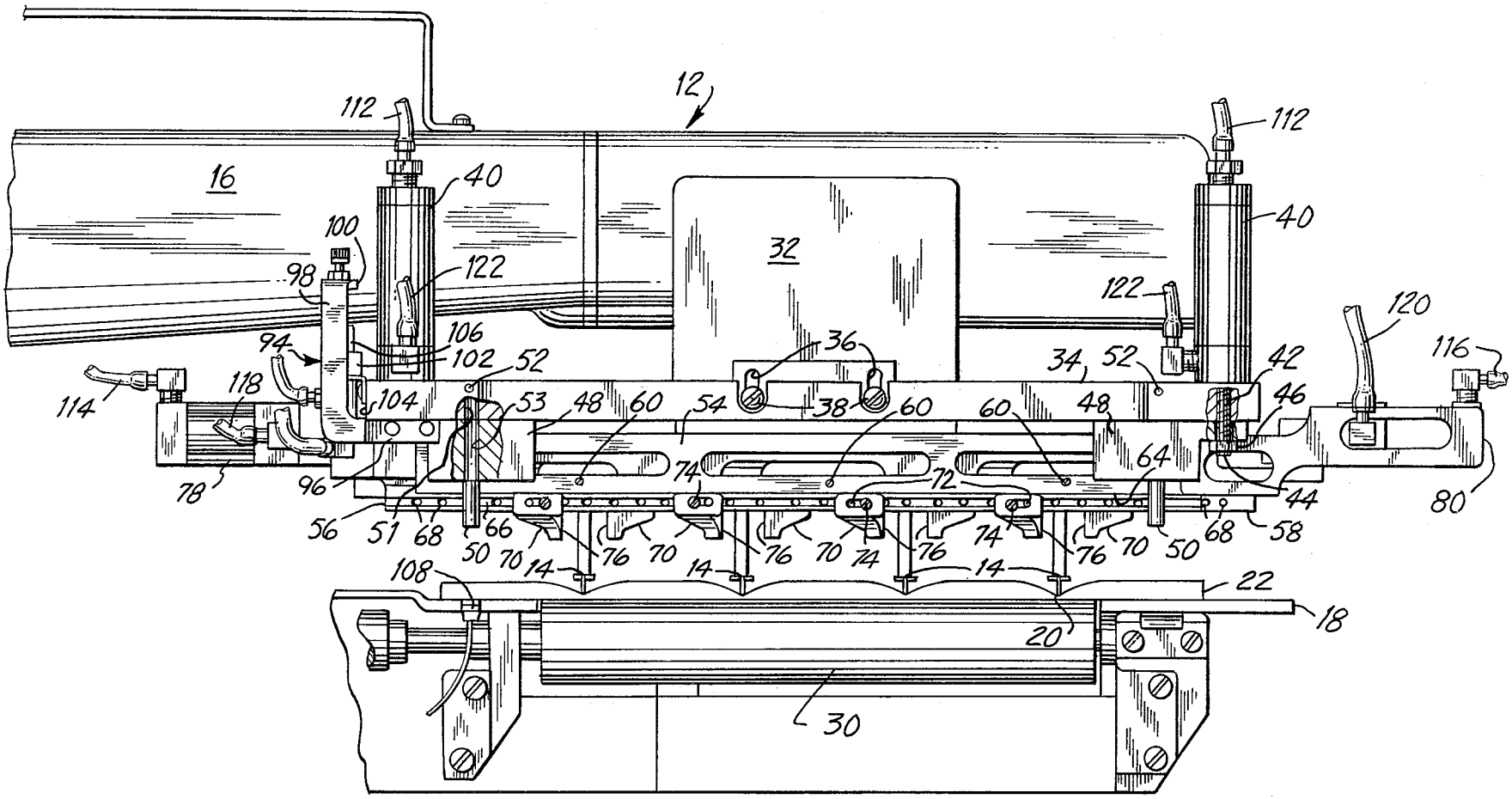
FIG. 3 is a rear view, partially in section, of a sewing machine and thread trimming apparatus prior to initiation of a thread trimming operation.
Figure 4:
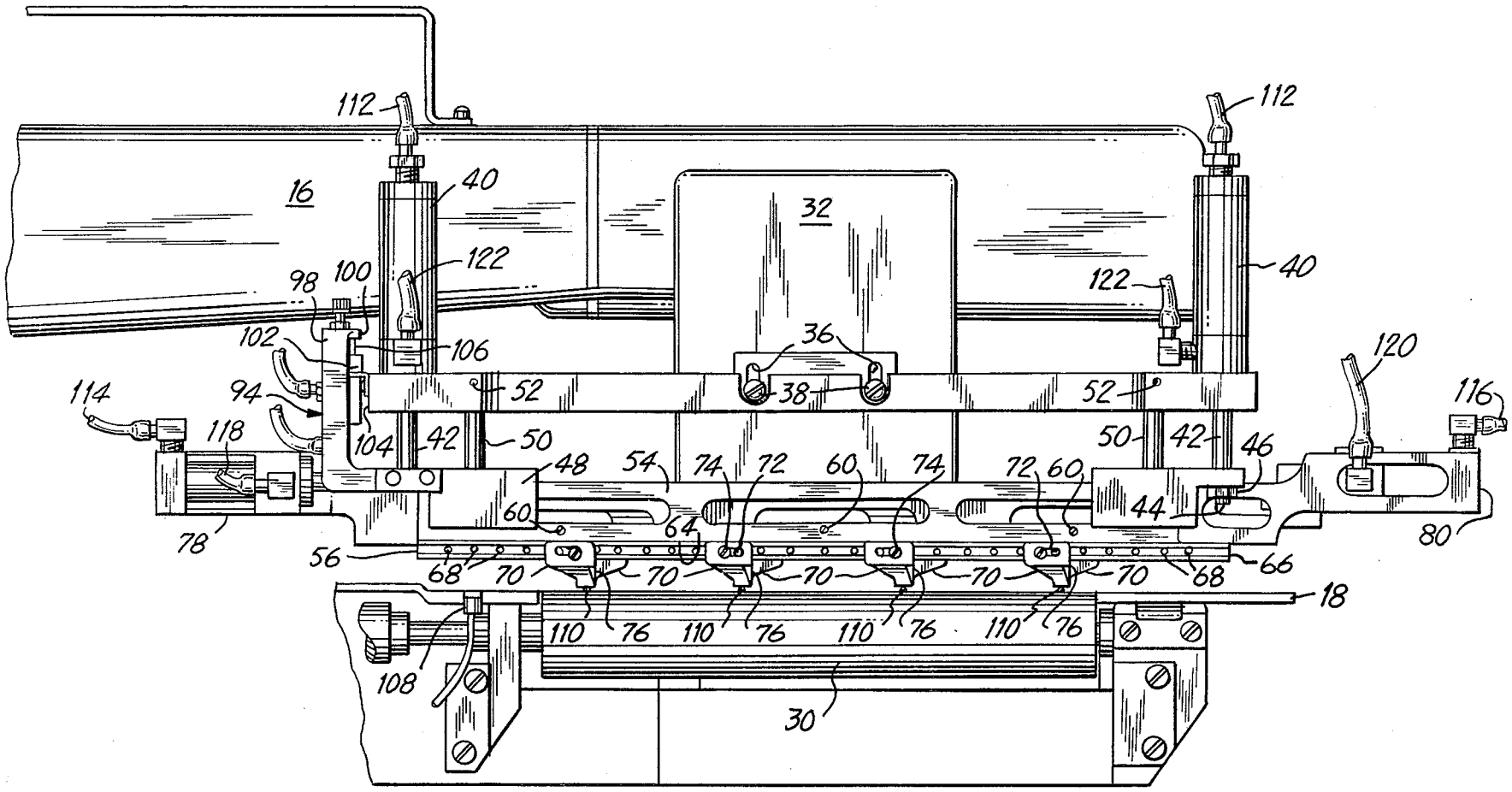
FIG. 4 also is a rear view, partially in section, of a sewing machine and thread trimming apparatus immediately after severance of the thread chains.

Workpiece 22 is approximately one half inch thick between seams 20. However, seams 20 compress the upper and lower surfaces of workpiece 22 close together, as shown in FIGS. 2, 3, and 4, so that workpiece 22 achieves a tucked and rolled effect. To achieve this effect, and to ensure a strong permanent bond, each seam 20 is constructed from a plurality of interlocking threads which define a continuous chain. Generally, the thread chain is constructed from two separate threads. However, a complex array of loops and knots in the thread chain ensures that most cross sections through the chain will intersect between four and seven thread sections.

Compressed gas source 27 and electrical control 29 cooperate to cause the operation of thread trimming apparatus 10, as explained in detail below.

As shown most clearly in FIG. 2, workpiece puller 24 is located approximately three inches away from thread trimming apparatus 10, and on the side of thread trimming apparatus 10 away from sewing machine 12. Workpiece puller 24 includes an axle 26 on which are rotatably mounted a plurality of discs 28. Axle 26 is substantially parallel to the array of needles 14, and perpendicular to the moving direction of workpiece 22 as indicated by arrow A. Workpiece puller 24 is operative to force discs 28 into contact with workpiece 22 as workpiece 22 advances past needles 14. Workpiece puller 24 is not mechanially driven, but cooperates with feeder 30 which is a roller disposed substantially flush with the surface of work table 18 and perpendicular to the moving direction A of workpiece 22. The feeder is rotated by the electrical motor of sewing machine 12. In operation, workpiece puller 24 forces workpiece 22 into contact with feeder 30, and feeder 30 in turn urges workpiece 22 in the direction indicated by arrow A.

Turning to FIG. 3, thread trimming apparatus 10 is rigidly, but releasably mounted on plate 32 located on the rear side of sewing machine 12. More specifically, thread trimming apparatus 10 includes frame 34 through which extend frame mounting apertures 36. Frame mounting bolts 38 pass through frame mounting apertures 36 and engage appropriately threaded apertures in plate 32 of sewing machine 12.

Frame 34 of thread trimming apparatus 10 is an elongated member, the longitudinal axis of which extends substantially parallel to work table 18 and to the plane defined by array of needles 14. Extending upwardly from frame 34 are vertical pneumatic cylinders 40 which, as explained further below, cooperate with compressed gas source 27 and electrical control 29 to move portions of thread trimming apparatus 10 through a plane perpendicular to the plane of work table 18. Vertical piston members 42 are slidably mounted in vertical pneumatic cylinders 40. Free ends 44 of vertical piston members 42 extend from vertical pneumatic cylinders 40, and are threaded to receive vertical piston nuts 46.

Vertical piston members 42 threadably engage and extend through threaded apertures in mounting blocks 48, and are further secured thereto by vertical piston nuts 46. Guide rods 50 also extend from frame 34 and through apertures 53 in mounting blocks 48. Specifically, guide rods 50 are securely engaged in apertures 51 in frame 34 by set screws 52, but are slidably mounted in apertures 50 in mounting block 48. By this arrangement, movement of vertical piston members 42 within their respective vertical pneumatic cylinders 40 will cause movement of mounting block 48 toward or away from frame 34. This movement of mounting blocks 48 relative to frame 34 is, in part, guided by the slidable movement of mounting blocks 48 along guide rod 50.

Channel frame 54 is an elongated structure having its longitudinal axis parallel to the axis of frame 34. Channel frame 54 has a U-shaped cross section, and is disposed such that the open portion of the U-shaped cross section is directed downward toward work table 18. Mounting blocks 48 are securely mounted on opposite ends of channel frame 54.

Blade mounting bars 56 and 58 are slidably mounted in channel frame 54 such that their respective longitudinal axes are parallel to the axis of channel frame 54. Blade mounting bars 56 and 58 are slidable within channel frame 54, and also are slidable with respect to each other. However, blade mounting bars 56 and 58 are retained in channel frame 54 by screws 60 which are threadably engaged in chanel frame 54, and extend through slots (not shown) in blade mounting bars 56 and 58 respectively. More specifically, the slots extend parallel to the longitudinal axes of blade mounting bars 56 and 58. The arrangement of screws 60 and longitudinally extending slots enables the blade mounting bars 56 and 58 to slidably move parallel to their axes, but prohibits movement perpendicular to their axes.

The widths of blade mounting bars 56 and 58 are equal, and are of sufficient dimension to enable blade mounting bars 56 and 58 to extend below the lower edge 64 of channel frame 54. As shown in FIGS. 2 and 3, the portion of blade mounting bar 56 that extends below the lower edge 64 of channel frame 54 includes a longitudinally extending groove 66. A plurality of threaded through apertures 68, spaced approximately $\frac{3}{8}$ inch apart, are disposed in groove 66. A similar groove 67 with threaded through apertures is disposed in the portion of blade mounting bar 58 which extends below the lower edge 64 of channel frame 54, as shown in FIG. 2.

Blades 70 are mounted on the portions of blade mounting bars 56 and 58 that extend below the lower edge 64 of channel frame 54. Specifically, each blade 70 is configured to engage groove 66 in blade mounting bar 56 or the corresponding groove 67 in blade mounting bar 58. Additionally, each blade 70 includes a slot 72. Screws 74 extend through slots 72 in blades 70 to threadably engage either threaded through apertures 68 in blade mounting bar 56, or the corresponding threaded thread apertures in blade mounting bar 58.

Each blade 70 includes a cutting edge 76. The cutting edges 76 of the blades 70 on blade mounting bar 56 all face one direction. The cutting edges 76 of the blades 70 on blade mounting bar 58 also all face one direction. However, the direction of cutting edges 76 of blades 70 on blade mounting bar 58 is opposite the direction of cutting edges 76 of blades 70 on blade mounting bar 56.

As shown in FIG. 3, an equal number of blades 70 are mounted on each blade mounting bar 56 and 58. Blades 70 are disposed on blade mounting bars 56 and 58 such that pairs of oppositely facing blades 70 are provided with one blade 70 of each pair being mounted on each blade mounting bar 56 or 58. Thus, the cutting edges 76 of the blades 70 in each pair face each other. By this arrangement, slidable movement of blade mounting bars 56 and 58 in channel frame 54 causes the blades 70 in each pair to move toward or away from each other. Turning to FIG. 4, it is shown that blades 70 are configured such that the slidable movement of blade mounting bars 56 and 58 in channel frame 54 causes the cutting edge 76 of each blade 70 to slidably communicate with the other blade 70 in that pair. This slidable movement effects a scissor-like communication between the blades 70 of each pair.

Figure 5:
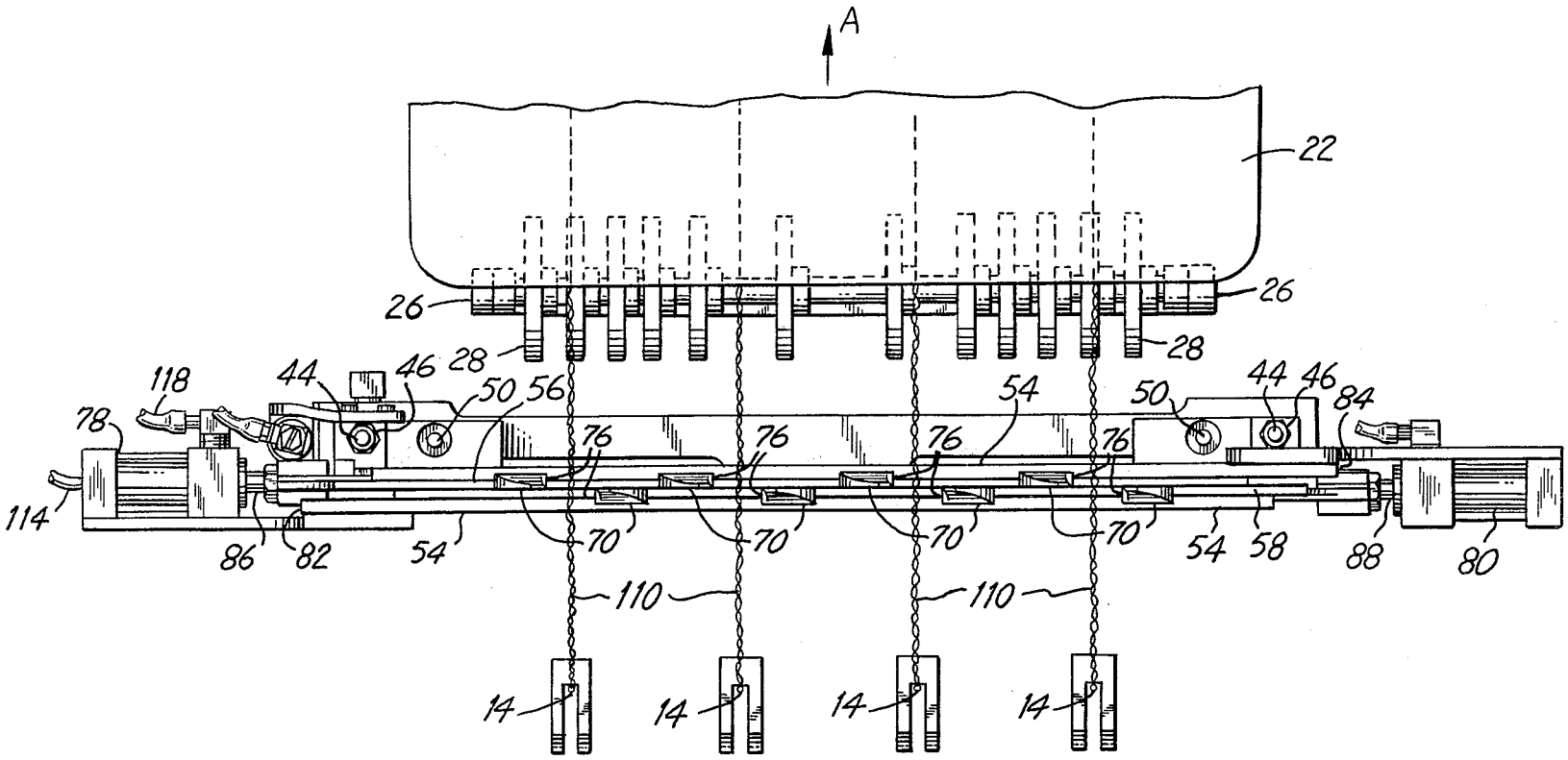
FIG. 5 is a bottom view, taken through the plane of the sewing machine work table, showing the subject thread trimming apparatus, the sewing machine needles, a workpiece, thread chains and the workpiece puller.

Referring now to FIG. 5, blades 70 are disposed on blade mounting bars 56 and 58 such that each pair of oppositely facing blades 70 is located centrally over seams 20 on workpiece 22.

Horizontal pneumatic cylinders 78 and 80 are rigidly mounted on opposite ends 82 and 84 of channel frame 54. Horizontal piston members 86 and 88 are slidably mounted in horizontal pneumatic cylinders 78 and 80 respectively, as shown in FIG. 5. The free end of horizontal piston member 86 is rigidly attached to blade mounting bar 56. Similarly, free end of horizontal piston member 88 is attached to blade mounting bar 58. By this arrangement, the slidable movement of horizontal piston members 86 and 88 in horizontal pneumatic cylinders 78 and 80 respectively causes the slidable movement of blade mounting bars 56 and 58 in channel frame 54. The range of movements of blade mounting bars 56 and 58 caused by horizontal piston member 86 and 88 is such that at one extreme the blades 70 of each pair of blades are separated by approximately one half inch (see FIGS. 3 or 5) whereas at the other extreme the cutting edges 76 of each blade 70 in each pair of blades slidably overlap by approximately one quarter inch (see FIG. 4).

L-shaped bracket 94, as shown in FIGS. 3 and 4, includes horizontal leg 96 and vertical leg 98. Horizontal leg 96 of L-shaped bracket 94 is rigidly mounted on mounting block 48 closest to end 82 of channel frame 54. Extending from the free end of vertical leg 98 of L-shaped bracket 94 is horizontally disposed stop 100. Stop 100 extends perpendicular to the plane defined by horizontal and vertical legs 96 and 98 toward sewing machine 12. Pneumatically operated trigger 102 is mounted on end 104 of frame 34. Plunger 106 is slidably engaged in pneumatic trigger 102, and is disposed directly beneath horizontal stop 100 of L-shaped bracket 94.

Photoelectric cell 108 is mounted in work table 18 and is located approximately three inches from thread trimming apparatus 10, and on the side thereof away from sewing machine 12. Photoelectric cell 108 is electronically connected to the electrical control 29 which coordinates the movement of the various members of thread trimming apparatus 10 as explained below. Additionally, photoelectric cell 108 is disposed in work table 18 such that workpiece 22 will pass directly over photoelectric cell 108 as workpiece 22 advances through sewing machine 12 (see FIGS. 4 and 5). In operation, as the trailing edge of workpiece 22 reaches a point approximately three inches from thread trimming apparatus 10, and on the side thereof away from sewing machine 12, workpiece 22 will no longer cover photoelectric cell 108. The ambient light striking photoelectric cell 108 will generate an electrical signal that will be detected by electrical control 29, which in turn will selectively direct pressurized gas from gas pressure source 27 toward vertical pneumatic cylinders 40 or horizontal pneumatic cylinders 78 and 80 to operate thread trimming apparatus 10 as explained herein.

Turning to FIGS. 4 and 5, sewing machine 12 continues to operate after the trailing edge of workpiece 22 has passed through the array of needles 14. This continued sewing operation generates thread chains 110. As explained previously, the interlocking arrangement of threads in seams 20 or thread chains 110 are subject to unraveling at their point of severance. By extending the thread chains 110 beyond the edge of workpiece 22, any unraveling of thread chains 110 that does occur will not effect seams 20 in workpiece 22. Also, as explained above, it is preferable to provide a chain of between two and one half and three inches extending from both the leading and trailing edges of workpiece 22.

Electrical control 29 includes a plurality of solenoid valves which are in communication with compressed gas source 27, vertical pneumatic cylinders 40 and horizontal pneumatic cylinders 78 and 80.

Upon receipt of the electrical signal from photoelectric cell 108, the electrical control 29 will open its downward solenoid valves that direct compressed gas through pneumatic tubes 112 to vertical pneumatic cylinders 40. The entry of compressed gas into vertical pneumatic cylinders 40 causes the downward movement of vertical pistons 42, which in turn causes the downward movement of mounting blocks 48, channel frame 54, blade mounting bars 56 and 58 and blades 70. The range of this vertical movement advances blades 70 downward to a point where they are at or slightly above the surface of work table 18, as shown most clearly in FIG. 3. At this lowermost position, plunger 106 on pneumatic trigger 104 contacts horizontal stop 100 on L-shaped bracket 94. Upon contact, plunger 106 slides into pneumatic trigger 102, thereby generating a pneumatic signal that is detected by a transducer member in the electronic control 29. The electrical impulse generated by the transducer member in electrical control 29 operates the inward solenoid valves in electrical control 29 to direct compressed gas from compressed gas source 27 through horizontal pneumatic tubes 114 and 116, which are connected to horizontal pneumatic cylinders 78 and 80 respectively.

The compressed gas from compressed gas source 27 entering horizontal pneumatic cylinders 78 and 80 causes movement of horizontal piston members 86 and 88 respectively, which in turn, causes the slidable movement of blade mounting bars 56 and 58 within channel frame 54. As a result, the blades 70 in each pair of blades advance toward each other to a point where their respective cutting edges 76 overlap by approximately $\frac{1}{4}$ inch as shown most clearly in FIG. 4. The movement of blades 70 in each pair of blades neatly severs the chain 110 about which each pair of blades had been centered.

Electrical control 29 is programmed to keep the blades 70 in each pair of blades in their overlapped alignment for approximately 50 milliseconds. After that time period has elapsed, electrical control 29 closes the inward solenoid valves so that compressed gas no longer is directed to horizontal pneumatic tubes 114 and 116. Simultaneously, electrical control 29 operates its outward solenoid valves causing compressed gas to be directed through horizontal pneumatic tubes 118 and 120 causing horizontal piston members 86 and 88 to slidably move within horizontal pneumatic cylinders 78 and 80 respectively to their initial positions. This return movement of horizontal piston members 86 and 88, of course, causes movement of horizontal blade mounting bars 56 and 58, thereby separating the blades 70 in each pair of blades. After the return of horizontal piston members 86 and 88 to their initial position, the electrical control 29 closes its downward solenoid valves so that compressed gas no longer is directed to vertical pneumatic tubes 112. Simultaneously, electrical control 29 operates its upward solenoid valves which direct compressed gas through vertical pneumatic tubes 122 thereby causing the upward movement of vertical piston members 42 within vertical pneumatic cylinders 40. The upward movement of vertical piston members 42, in turn, causes the upward movement of mounting blocks 48, channel frame 54, blade mounting bars 56 and 58 and blades 70. By this vertical movement, blades 70 are returned to their initial position, wherein they are separated from work table 18 by a sufficient distant to enable the next workpiece 22 to pass between blade 70 and work table 18.

Preferably, the electronic control 29 is programmed to allow between 100 and 200 milliseconds between the downward and upward movement of vertical piston members 42. This programmed elapsed time amply enables the inward and outward movement of horizontal piston members 86 and 88.

During the short interval of time between the initial downward movement of blades 70 and the termination of the upward movement of blades 70, sewing machine 12 may be continually operated. The thread chain 110 that will be generated during this period of operation will extend from the leading edge of the next workpiece 22 thereby insuring that any unraveling of thread chain 110 will not effect the seam 20 to be sewn in the next workpiece 22. These thread chains 110 extending from the leading end of the next workpiece 22 will be approximately three inches long as a result of the $2\frac{1}{2}$ inches between the blades 70 of thread trimming apparatus 10 and the array of needles 14 plus the additional thread chain 110 generated during the 100 to 200 milliseconds of the thread cutting operation. As an alternative, the electronic control could include a means for reducing the sewing speed during a thread cutting operation, or stopping a sewing operation entirely. The latter option has the advantage of providing the sewing machine operator with an opportunity to pick up and properly align the next workpiece 22 to be sewn.

Although thread trimming apparatus has been described with reference to pneumatically generated movements, a hydraulic or completely electrical system would be equally effective. Similarly, the system has been described for simultaneous and opposite movement of both blade mounting bars 56 and 58. However, the system could be designed such that one blade mounting bar remains stationary and the other moves. Additionally, the device could be actuated by a means other than the photoelectric cell.

In summary, a thread trimming apparatus is provided for use with an industrial sewing machine. The subject apparatus can be used with sewing machines having either one or a plurality of needles. Furthermore, the apparatus can easily be adapted for different spacings of needles. The thread trimming appratus is mounted on the side of the sewing machine opposite the operator, thereby ensuring that the operator is separated from the moving parts of the apparatus. The apparatus includes a pair of oppositely facing blades for each needle on the sewing machine. One blade of each pair is mounted on one blade mounting bar, and the other blade of each pair is mounted on a second mounting bar. The blade mounting bars are parallel and in slidable relationship to one another. Thus, slidable movement of the blade mounting bars causes the blades in each pair to move toward or away from each other. Vertical pneumatic cylinders are provided to cause the blade mounting bars and blades to move up or down through a vertical plane. Horizontal pneumatic cylinders are provided to enable the respective blade mounting bars and blades to move toward or away from each other. In operation, the blade mounting bars and blades are moved downward so that the blades are at or slightly above the level of the sewing machine work table, and so that each pair of blades is centered about a thread chain generated by one of the sewing machine needles. After completion of the downward movement, the horizontal pneumatic cylinders are activated to cause the blades in each pair to move toward each other into an overlapping alignment, and subsequently to move away from each other to their initial horizontal position. Finally, after completion of the inward and outward horizontal movements of the blades, the vertical pneumatic cylinders cause the blade mounting bars and blades to move upward to their initial position, thereby enabling the next workpiece to be sewn. By this arrangement, appropriately dimensioned thread chains are provided extending from both the leading and trailing edges of each workpiece thus ensuring a properly secured seam in the workpiece. The automated operation of the subject thread trimming apparatus frees the sewing machine operator from the arduous and inefficient task of manually cutting each of the thread chains.

While the preferred embodiment of the subject invention has been described and illustrated, it is obvious that various changes and modifications can be made therein without departing from the spirit of the present invention which should be limited only by the scope of the appended claims.

What is claimed is:

1. A thread trimming apparatus for use with a sewing machine having at least one needle, said needle being operative to produce an array of stitches, said apparatus for severing said array of stitches, said apparatus comprising:

a frame means;

first and second blade mounting means slidably connected to said frame means and in slidable relationship with each other;

positioning means connected to said sewing machine and said frame means for selectively moving said frame means with respect to said sewing machine and towards or away from said array of stitches;

a pair of opposed blade means for each said needle, each said pair comprising a first blade means mounted on said first blade mounting means and a second blade means mounted on said second blade mounting means;

blade actuating means for selectively generating slidable movement of said first and second blade mounting means relative to each other and relative to said frame means; and control means for actuating said positioning means and said blade actuating means, said control means being operative to cause said positioning means to move said frame means toward said array of stitches and to cause said blade actuating means to generate slidable movement between said first and second blade mounting means such that each said pair of blade means straddles and severs one said array of stitches, and after which said positioning means moves said frame means away from each said array of stitches.

2. A thread trimming apparatus as in claim 1 wherein said first and second blade mounting means are elongated and are disposed parallel to each other and perpendicular to said needle.

3. A thread trimming apparatus as in claim 2 wherein said frame means is an elongated channel frame having a U-shaped cross section, the longitudinal axis of said channel frame being parallel to the axes of said first and second blade mounting means, said first and second blade mounting means being slidably mounted therein.

4. A thread trimming apparatus as in claim 3 wherein said positioning means comprises at least one positioning piston and cylinder assembly having a positioning cylinder rigidly connected to said sewing machine and having a positioning piston rigidly connected to said channel frame, said positioning means further comprising a means for generating slidable movement of said positioning piston within said positioning cylinder thereby causing movement of said channel frame with respect to said sewing machine toward or away from said array of stitches.

5. A thread trimming apparatus as in claim 3 wherein said blade actuating means comprises at least one blade actuating piston and cylinder assembly having a blade actuating cylinder rigidly connected to said channel frame and having a blade actuating piston rigidly connected to said first or second blade mounting means, said blade actuating means further comprising a means for causing slidable movement of at least one blade actuating piston within the at least one blade actuating cylinder thereby causing slidable movement between said first and second blade mounting means.

6. A thread trimming apparatus as in claim 4 wherein said means for generating slidable movement of said positioning piston within said positioning cylinder comprises a compressed gas source in communication with said control means and with said positioning piston and cylinder assembly.

7. A thread trimming apparatus as in claim 5 wherein said means for generating slidable movement of said blade actuating piston within said blade actuating cylinder in said at least one blade actuating piston and cylinder assembly comprises a compressed gas source in communication with said control means and with said at least one blade actuating piston and cylinder assembly.

8. A thread trimming apparatus as in claim 1 further comprising at least one photoelectric cell in communication with said control means and located a distance from said first and second blade mounting means corresponding to a desired length for each said array of stitches, whereby when a workpiece being sewn on said sewing machine passes said photoelectric cell, said cell generates a signal and whereby said control means detects said signal to initiate a cutting operation of said apparatus.

9. A thread trimming apparatus as in claim 1 wherein said positioning means and said blade actuating means comprise positioning and blade actuating pneumatic piston and cylinder assemblies, and wherein said apparatus further comprises a compressed gas source in communication with said control means and with said positioning and blade actuating pneumatic piston and cylinder assemblies to operate said positioning and blade actuating pneumatic piston and cylinder assemblies.

10. A thread trimming apparatus as in claim 9 wherein said control means includes a plurality of solenoid valves in communication with said compressed gas source and said positioning and blade actuating pneumatic piston and cylinder assemblies, said control means sequentially opening and closing said solenoid valves causing compressed gas from said compressed gas source to sequentially operate said positioning and blade actuating pneumatic piston and cylinder assemblies.

11. A thread trimming apparatus as in claim 1 wherein said first and second blade means are adjustably mounted on said first and second blade mounting means.

12. A thread trimming apparatus as in claim 7 wherein said apparatus comprises first and second blade actuating piston and cylinder assemblies having first and second blade actuating pistons respectively, the first blade actuating piston being rigidly connected to said first blade mounting means and the second blade actuating piston being rigidly connected to the second blade mounting means.

13. A pneumatically operated thread trimming apparatus for use with a sewing machine having a plurality of needles, each said needle for producing an array of stitches in a workpiece, said apparatus for severing each said array of stitches, said apparatus comprising:

an elongated support frame for mounting said apparatus on said sewing machine;

an elongated channel frame having a U-shaped cross section, said channel frame being parallel to said support frame and being disposed such that the open side of said U-shaped cross section is directed away from said support frame;

a pair of vertically disposed pneumatic piston and cylinder assemblies each having a vertical cylinder fixedly attached to said support frame and a vertical piston rigidly attached to said channel frame, such that slidable movement of said vertical pistons within said vertical cylinders causes movement of said channel frame toward or away from the arrays of stitches;

first and second blade mounting bars in slidable relationship with each other and slidably mounted in said channel frame;

a pair of blades aligned with each said needle on said sewing machine, one blade of each said pair of blades being adjustably mounted on said first blade mounting bar and the other blade of each said pair of blades being adjustably mounted on the second blade mounting bar such that the cutting edges of said blades in each said pair of blades are facing each other and such that slidable movement of said first and second blade mounting bars with respect to each other moves the cutting edges of said blades and each said pair of blades toward or away from each other;

first and second horizontal pneumatic piston and cylinder assemblies, said first horizontal pneumatic piston and cylinder assembly having a first horizontal cylinder mounted on a first end of said elongated channel frame and having a first horizontal piston portion mounted on said first blade mounting bar, said second horizontal pneumatic piston and cylinder assembly having a second horizontal cylinder mounted on a second end of said elongated channel frame and having a second horizontal piston member mounted on said second blade mounting bar such that slidable movement of said first and second horizontal pistons within said first and second horizontal cylinders respectively causes slidable movement of said first and second blade mounting bars with respect to each other;

a compressed gas source in communication with each said piston and cylinder assembly; and a control member including a plurality of solenoid valves for selectively directing compressed gas from said source of compressed gas to said piston and cylinder assemblies, such that compressed gas is directed to said vertical pneumatic piston and cylinder assemblies to move said channel frame toward said arrays of stitches, compressed gas then is directed to said first and second horizontal pneumatic piston and cylinder assemblies to sever each said array of stitches, and then compressed gas is directed to said vertical pneumatic piston and cylinder assemblies to move said channel frame away from said arrays of stitches.

* * * * *